US005558321A

United States Patent [19]

Greive et al.

[11] Patent Number: 5,558,321

[45] Date of Patent: Sep. 24, 1996

[54] DEVICE FOR FACILITATING SHEET SEPARATION OR SINGLING

[75] Inventors: Martin Greive, Heidelberg; Bernd Ruf, Weiterstadt, both of Germany

[73] Assignee: Heidelberger Druckmaschinen AG, Heidelberg, Germany

[21] Appl. No.: 364,536

[22] Filed: Dec. 27, 1994

[30] Foreign Application Priority Data

Dec. 24, 1993 [DE] Germany ..... 43 44 453.9

[51] Int. Cl.[6] ..... B65H 3/14

[52] U.S. Cl. ..... 271/98; 271/105

[58] Field of Search ..... 271/98, 104, 105, 271/106, 107, 233, 241, 253

[56] References Cited

U.S. PATENT DOCUMENTS

| | | | |
|---|---|---|---|
| 854,222 | 5/1907 | Knapp | 271/98 |
| 4,786,043 | 11/1988 | Jiruse et al. | 271/105 X |

FOREIGN PATENT DOCUMENTS

| | | | |
|---|---|---|---|
| 3706747 | 9/1987 | Germany . | |
| 3619676 | 12/1987 | Germany . | |
| 1781151 | 12/1992 | U.S.S.R. | 271/98 |
| 2204568 | 11/1988 | United Kingdom | 271/98 |

*Primary Examiner*—William E. Terrell
*Assistant Examiner*—Tamara Kelly
*Attorney, Agent, or Firm*—Herbert L. Lerner; Laurence A. Greenberg

[57] ABSTRACT

Device for facilitating sheet separation or singling in an upper region of a feeder pile, wherein equipment for acting upon an edge of the feeder pile facing away from a processing machine is adjustably movable against lateral edges of the sheet pile, includes a supporting structure disposed above a feeder pile and extending beyond dimensions of a maximally processable format of a printing material and being swivellable out of a plane extending parallel to a top surface of the feeder pile, and elements for facilitating sheet separation carried by said supporting structure.

2 Claims, 3 Drawing Sheets

DEVICE FOR FACILITATING SHEET SEPARATION OR SINGLING

BACKGROUND OF THE INVENTION

1. Field of the Invention

The invention relates to a device for facilitating sheet separation or singling, more particularly, in an upper region of a feeder pile, wherein equipment for acting upon an edge of the feeder pile facing away from a processing machine are provided on a supporting structure, the equipment being movable into engagement with lateral edges of the sheet pile.

Published German Patent Document DE 36 19 676 Al discloses a separating device for a multi-layer pile formed of layers of sheets. A leafing device for leafing through the layers of sheets from top to bottom and for detecting the location of cardboard sheets separating individual bundles of sheet layers is assigned to a corner of a multi-layer pile. The sheet layers disposed above a respective determined separating location are lifted so that separating heads may move into the opened separating location, and thus move out respective separated partial quantities of layers of the multi-layer pile from a superimposed congruent location thereof.

The separating device is located at the trailing edge of a multi-layer pile. Although the separating heads are movable in a horizontal plane, they cannot be moved away entirely from the pile. This applies as well to the leafing device which is disposed in a stationary position at a corner of a pile and only scans or tracks in a vertical direction. This requires that the pile be refilled from below, which calls for specific constructional prerequisites which cannot always be provided.

Published German Patent Document 37 06 747 Al discloses a device for automatically infeeding paper layers into a processing machine. Within a supporting structure mounted fixed in position, two carriages are movable on two rack-and-pinion or gear-rack guides. The carriages carry two spindles holding two separating units which are connected to one another and are movable on the spindles. Each of the separating units includes separating means, a retainer or hold-down bar, and a sliding element which, in turn, are fastened to four-bar transmissions. Furthermore, respectively, a pressure roller and a separating blade are arranged on the separating units to enable the separation of individual partial quantities of layers in an upper region of the pile of sheet layers.

With this heretofore known device, it is not possible to facilitate the separation of sheets on a feeder pile and to continuously supply the printing material to a further processing machine, because the pile region is surrounded by a stationary supporting structure, and it is time-consuming and difficult to reach the pile region from the outside for the purpose of refilling the pile from above or from a side, for example.

With feeders of small sheet-fed rotary printing presses, new sheets are replenished on a feed board as soon as the feeder pile has decreased. Heretofore, in the case of a format change, each of the individual elements making-ready or preparing the alignment of the upper region of the feeder pile had to be moved away individually from the pile region and even disassembled therefrom in order to gain direct access to the pile. Only then, could the new sheets be stacked easily and quickly. If the replenished piled sheets are of a different sheet size or format, each aligning element has to be adjusted so as to match or be accommodated to the changed format, which has heretofore resulted in rather lengthy make-ready time periods. Furthermore, it has become apparent that, under certain circumstances, the sheets are not loosened up all the way to the respective trailing edge of the upper region of the feeder pile nor does air blown underneath the upper region of the feeder pile extend to the trailing edge thereof. In fact, the upper sheets of a light printing material have been completely blown off the surface of the pile if too much blowing air is supplied. Furthermore, it has become desirable to protect prestacked copies of small sheet sizes or formats against impacts and the like in order to leave them in the prestacked position, if possible, and to avoid a renewed pile preparation.

Proceeding from the state of the art as outlined above and from the inadequacies of the prior attempts to find a solution for the problem, it is an object of the invention of the instant application to provide a device for facilitating sheet separation or singling with which accessibility of a feeder-pile region and ability to effect format adjustments quickly are considerably improved over the state of the art.

SUMMARY OF THE INVENTION

With the foregoing and other objects in view, there is provided, in accordance with the invention, a device for facilitating sheet separation or singling in an upper region of a feeder pile, wherein equipment for acting upon an edge of the feeder pile facing away from a processing machine is adjustably movable against lateral edges of the sheet pile, comprising a supporting structure disposed above a feeder pile and extending beyond dimensions of a maximally processable format of a printing material and being swivellable out of a plane extending parallel to a top surface of the feeder pile, and elements for facilitating sheet separation carried by the supporting structure.

In accordance with another feature of the invention, the supporting structure is swivellable about a swivel axis disposed approximately in the middle of the dimensions of the maximally processable format of the printing material.

In accordance with a further feature of the invention, the device includes a guide provided on the supporting structure and extending in sheet-separating direction.

In accordance with an added feature of the invention, the device includes a traverse movable slide-like on the supporting structure in a direction parallel to sheet-separation direction, and locking means for fixing the traverse in an arbitrary position.

In accordance with an additional feature of the invention, the traverse comprises a guide body and a connecting piece. In accordance with yet another feature of the invention, the traverse carries at least one blower horizontally displaceable in a respective recess formed in the supporting structure.

In accordance with yet a further feature of the invention, the traverse is formed with a guiding surface, and stops are included for acting upon the trailing edge of the feeder pile, the stops being received in recesses formed in the guiding surface.

In accordance with yet an added feature of the invention, the device includes projections disposed adjacent the stops and below the guiding surface.

In accordance with yet an additional feature of the invention, the traverse includes a guide body having bearing means including the guide for smoothly guiding the traverse without tilting.

In accordance with a concomitant feature of the invention, the device includes air-supply pipes located substantially in vicinity of the traverse.

The advantages of the foregoing constructions according to the invention are, above all, that it is now possible to make the sheet-pile region readily accessible; time-consuming adjustments and disconnecting operations are no longer necessary. Because the dimensions of the supporting structure are somewhat larger than the dimensions of the sheet size or format maximally processable, the supporting structure also serves as a guard against undesired external effects. The make-ready times needed for format changes can be reduced considerably due to the constructions according to the invention because all elements facilitating the sheet separation can be readily brought into engagement on the supporting structure.

In a further development of the idea upon which the invention is based, the supporting structure is mounted so as to be swivellable about a swivel axis provided approximately in the middle with respect to the dimensions of a maximally processable format of printing material. When it is being swivelled upwardly, the supporting structure thus reaches a position permitting direct access both to the pile and to the printing unit. The supporting structure has a guide extending parallel to the direction of sheet separation. Furthermore, a traverse can be moved on the supporting structure, like a slide or sleigh, parallel to the separating device of the sheets and can be locked in any arbitrary position by means of a locking device. The traverse comprises a guide body and a connecting piece. Moreover, at least one horizontally displaceable blower is mounted on the displaceable traverse. The traverse also includes a guiding surface on which stops guided in recesses and acting upon the respective trailing edge of the feeder pile are mounted.

On one hand, the stops prevent the sheets from being displaced on the surface of the feeder pile, if too much blowing air is supplied; on the other hand, it is also possible to loosen up the trailing edges of sheets on the feeder pile, if the blowing air supplied at the side of the leading-sheet edge is not spread underneath the entire sheet area.

The stops are provided with projections for preventing the trailing-sheet edges from being clamped. The stops, the blowers, and the traverse can be displaced on the supporting structure, after the respective tommy screws have been loosened; after the stops, the blowers, and the traverse have been displaced, the tommy screws can be tightened again in any arbitrary position. The smooth displacement of the traverse on the supporting structure is also facilitated by mounting, via bearing means, a guide body on a guide so that it is movable without being tilted. Because the pipes through which the blowing air flows are also arranged substantially in the vicinity of the traverse which is displaceable on the supporting structure, the pipes are swivelled beyond the pile region the instant the supporting structure is swivelled upwardly. In so doing, pipes or hoses forming loops and representing a danger of causing injuries are moved out of the sheet piling or stacking region.

Other features which are considered as characteristic for the invention are set forth in the appended claims.

Although the invention is illustrated and described herein as embodied in a device for facilitating sheet separation or singling, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
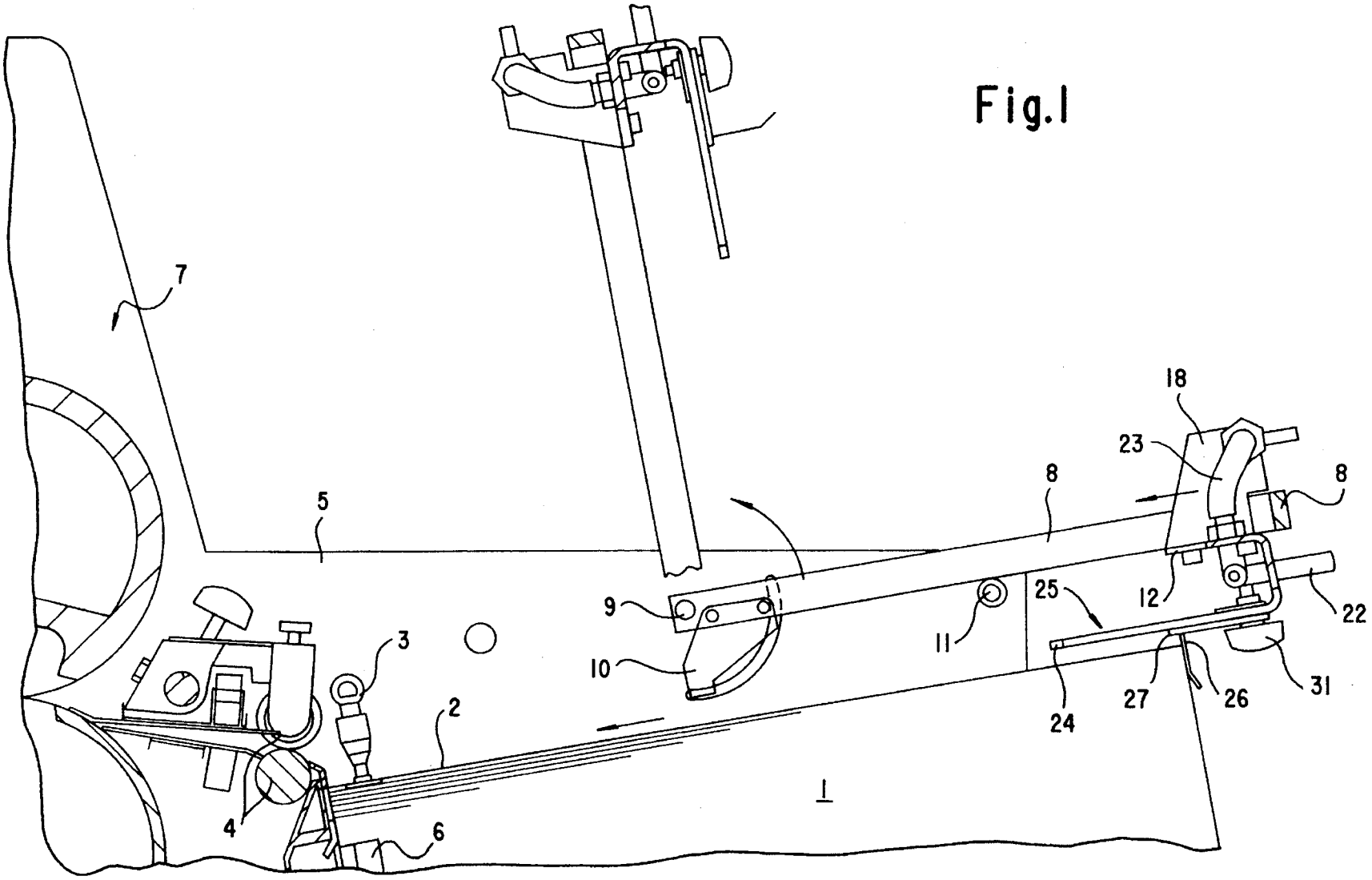
FIG. 1 is a side elevational view of the upper region of a feeder pile wherein a supporting structure or framework forming part of the invention is shown in a position parallel to the pile surface, as well as in a position swivelled 90° counter-clockwise.

Referring now to the drawings and, first, particularly to FIG. 1 thereof, there is shown therein, in a side elevational view, a feeder pile having a swivellable supporting structure or framework, represented in two swivelled positions thereof.

By means of suckers fastened to a suction bar 3, sheets 2 are conveyed from a feeder pile 1 to conveyor rollers 4 from which the sheets 2 are transported to a printing unit 7 of a rotary printing press. In a region facing towards the printing unit 7, the feeder pile 1 is provided with laterally adjustable pile guides 6. A swivel axis 9 about which a frame-like supporting structure 8 is swivellable is mounted in narrow side parts or frames 5 extending forward of the printing unit 7. The supporting structure 8 carries a stop or swivel-limiting means 10 formed with an angular-shaped extension which is guided in a recess formed in the respective side part 5. The vertical position of the supporting structure 8 shown in FIG. 1 is defined by the upper position of the stop or swivel limiter 10.

In the position wherein the supporting structure 8 is swivelled into contact with the feeder pile 1, the supporting structure 8 rests on supports 11. When it has been swivelled into contact with the feeder pile 1, the supporting structure 8 is located parallel to the surface of the feeder pile 1. The swivel axis 9 is positioned so that it is preferably located approximately in the middle of the region determined by the dimensions of the maximally processable format or size. A traverse 12 is displaceable on the supporting structure 8 in the direction of the sheet-separation or sheet-singling motion and is guided by means of a connecting piece 18 and a guide body 13 (note FIG. 2, for example). The connecting piece 18 is provided with an air-supply pipe 23 via which, by means of further air-supply pipes 22, the traverse 12 is supplied with blowing air (note FIG. 2). In a lower region thereof, the traverse 12 is formed with a guiding surface 24 comprising slit-shaped recesses 25. For effecting format adjustments, stops 26 are displaceable into the recesses 25. For this purpose, clamping means 31, i.e., a tommy screw, are loosened and the stop 26 is displaced. On each stop 26 there is provided a respective projection 27 which prevents a respective trailing edge of a sheet 2 from being clamped between the stop 26 and the guiding surface 24. The projections 27 are provided in such manner on the respective stops 26 that they project into the pile region of the feeder pile 1 at the trailing edge thereof.

Figure 2:
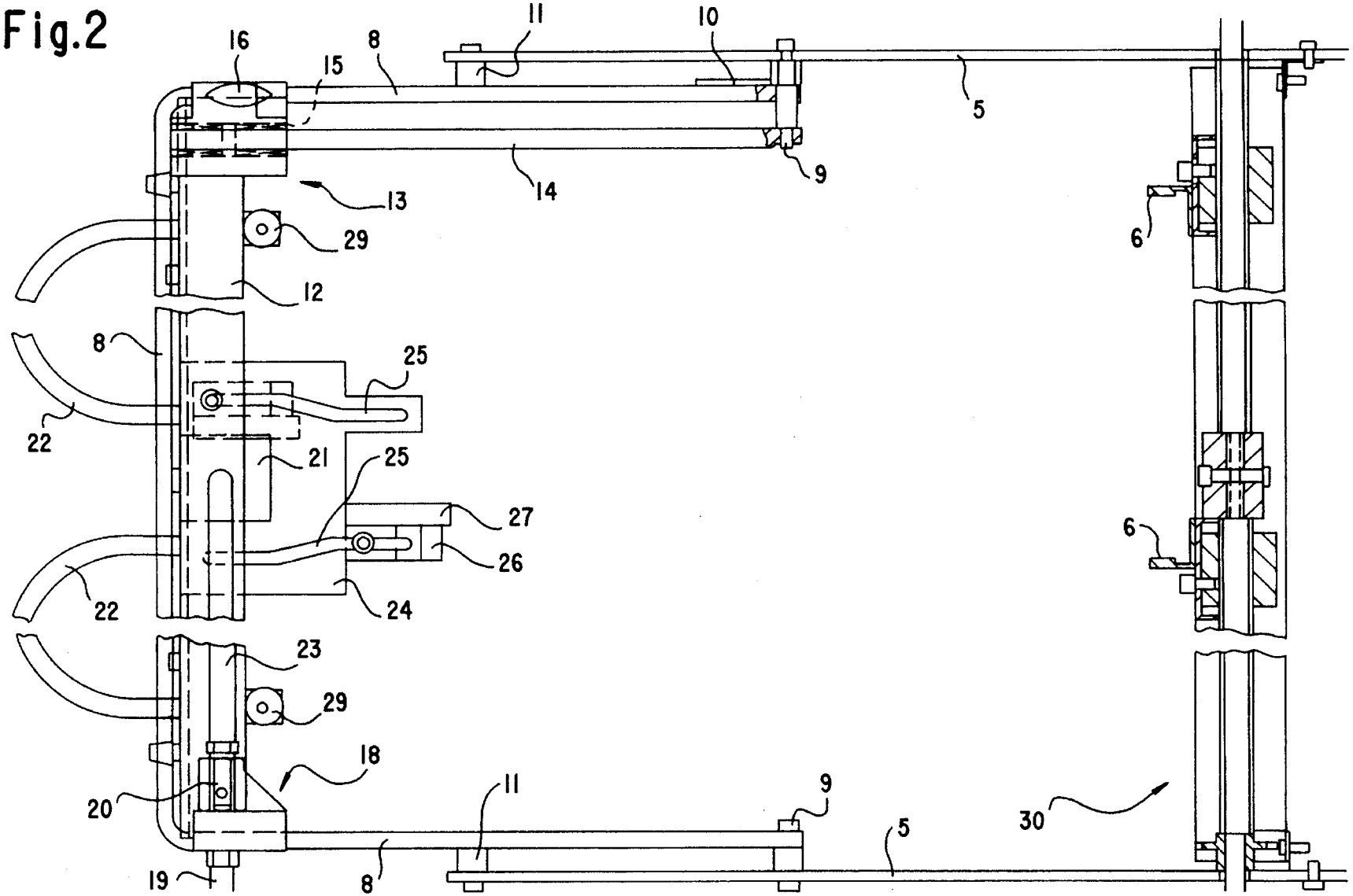
FIG. 2 is a top plan view of FIG. 1 rotated 180° and showing the supporting structure or framework mounted on side parts and equipment for facilitating sheet singling or separation, which forms part of the invention, disposed on a traverse.

According to the top plan view of FIG. 2, the supporting structure or framework 8 mounted in the side parts 5 is U-shaped and extends rearwardly beyond the side parts 5 which carry the swivel axis 9. This provides a limit for the upper pile region which is swivellable upwardly; but when the supporting framework 8 rests on the supports 11, however, it screens or protects the feeder pile 1. Thus, the sheets 2 in the upper region of the feeder pile 1 are protected against effects from outside which otherwise might cause the sheets which are already stacked to be displaced with respect to one another.

Furthermore, FIG. 2 shows a parallel guide 14 provided within the supporting structure 8. By means of the guide 14, the traverse 12 can be displaced on the supporting structure 8 without being tilted, after a tommy screw 16 has been loosened. The guide body 13 is provided with a bearing 15 which permits a smooth displacement of the traverse 12 in the sheet-separating direction. By means of the tommy screw 16, the traverse 12 can be fixed again in any position depending upon the format of the printing material to be processed. Due to the precise slide-like guidance of the traverse 12 on the supporting structure 8, the pressman can perform the displacement with only one hand. The top plan view according to FIG. 2 also shows the outlines of the recesses 25 formed in the guiding surface 24. If both stops 26 are displaced into a forward position thereof, they are brought into an even closer relationship with respect to one another due to the outlines or contours of the recesses 25, in order to provide format adjustments to small sheet sizes. In the left-hand recess, the broken line shows the stop 26 with the projection 27 in a rearward position, whereas in the right-hand recess 25, the stop 26 with the projection 27 is in a quite forward position.

An air-supply pipe 19 which may be activated by a stopcock 20 is connected to the connecting piece 18 of the traverse 12. An air-supply pipe 23 extends from the connecting piece 18 to a distributor or manifold 21. Via other pipes, the distributor or manifold 21 fastened to the traverse 12 directs the blowing air to a respective blower 29. The air-supply pipes 22 and 23 are mounted on the traverse 12 and are moved out of the pile region when the supporting structure 8 is swivelled upwards so that, without any hindrance, new sheets 2 may be stacked between the pile guides 6 which are laterally adjustable on a spindle 30.

Depending upon the format of the printing material to be stacked anew, the pile guides 6 are moved apart from one another, the supporting structure 8 is swung upwardly, and the sheets 2 are newly stacked. After a new feeder pile 1 has been stacked in this manner, the supporting structure 8 is moved downwardly. In a position extending parallel to the surface of the feeder pile 1, the supporting structure 8 then rests on the supports 11. The pressman adjusts the traverse 12 with a handle so that it is located approximately in the vicinity of the trailing edge of the feeder pile 1, where the traverse 12 is fixed in position. The stops 26 permit fine adjustments with respect to the guiding surface 24 by means of the clamping means 31. In the recesses 25, the stops 26 can be moved up to the trailing edge of the feeder pile 1 until the stops 26 contact the sheets 2. Furthermore, the blowers 29 may be displaced on the traverse 12 parallel to the trailing edge of the feeder pile 1.

Figure 3:
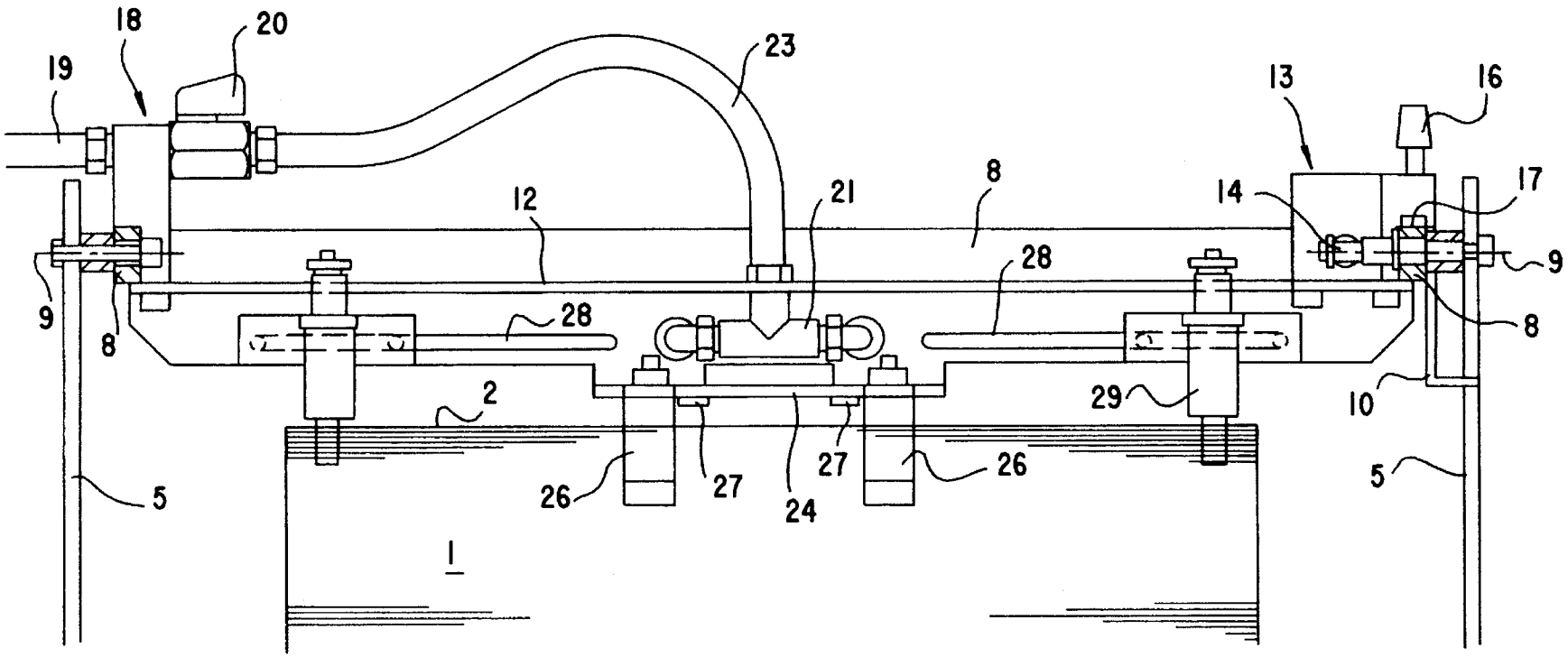
FIG. 3 is a front elevational view of FIG. 1 as seen from the right-hand side of the latter figure and showing the supporting structure or framework lowered onto the surface of the feeder pile.

FIG. 3 provides a front view of the supporting structure 8 in the position thereof wherein it has been swivelled into contact with the feeder pile 1.

The blowers 29 which have been moved into the outer regions of the feeder pile 1 are displaceable in horizontal slits 28 and are adjusted depending upon the respective sheet size. The blowers 29 produce an air cushion underneath the uppermost sheets 2 on the feeder pile 1, while the stops 26 prevent an undesired backward motion of the sheets 2 on the feeder pile 1. In the region of the guide body 13, a clamping body 17 is provided below the tommy screws 16 and holds the guide body 13 and the traverse 12 on the supporting structure 8, after the tommy screw 16 has been tightened.

Because the mounting stops 26, the projections 27, the blowers 29, the air-supply pipes 22 and 23 are mounted on the traverse 12 displaceable on the supporting structure 8, direct access to the feeder-pile region is afforded, after the traverse has been swivelled upwardly about the swivel axis, an action which may be facilitated by a pneumatic cylinder. With the feeder in operation, the supporting structure 8 protects the upper pile region against external influences acting upon the sheets 2 on the pile 1 so that the sheet separation can be effected in a trouble-free manner.

I claim:

1. Device for facilitating sheet separation or singling in an upper region of a feeder pile, wherein the feeder pile has a top surface, an edge facing away from a processing machine, and an edge surface extending substantially perpendicularly to the top surface, comprising a supporting structure disposed above a feeder pile and extending beyond dimensions of a maximally processable format of a printing material and being swivellable out of a plane extending parallel to a top surface of the feeder pile, elements for facilitating sheet separation carried by said supporting structure, said elements being adjustably movable against an edge surface of the feeder pile when said supporting structure is swivelled into the plane extending parallel to the top surface of the feeder pile, a traverse movable slide-like on said supporting structure in a direction parallel to sheet-separation direction, and locking means for fixing said traverse in an arbitrary position said traverse being formed with a guiding surface, and including stops for acting upon the trailing edge of the feeder pile, said stops being received in recesses formed in said guiding surface.

2. Device according to claim 1, including projections are disposed adjacent said stops and below said guiding surface.

* * * * *